US005504541A

United States Patent [19]

Kolton et al.

[11] Patent Number: 5,504,541

[45] Date of Patent: Apr. 2, 1996

[54] EYEGLASSES HANGER HAVING A REDUCED THICKNESS PORTION VERTICALLY ADJACENT THE TAIL SEGMENT OPENING

[75] Inventors: Chester Kolton, Westfield; Stuart S. Spater, Livingston, both of N.J.

[73] Assignee: B&G Plastics, Inc., Newark, N.J.

[21] Appl. No.: 420,198

[22] Filed: Apr. 11, 1995

Related U.S. Application Data

[63] Continuation-in-part of Ser. No. 366,254, Dec. 29, 1994.

[51] Int. Cl.[6] ..... G02C 1/00; G02C 3/00

[52] U.S. Cl. ..... 351/158; 351/155; 248/902; 24/3.3

[58] Field of Search ..... 351/41, 155, 158; 248/309.1, 317, 902, 690, 340; 211/13, 59.1; 206/5; 24/3 C

[56] References Cited

U.S. PATENT DOCUMENTS 5,129,617 7/1992 MacWilliamson ..... 248/690

5,340,074 8/1994 Porcaro et al. ..... 248/902 X

*Primary Examiner*—William L. Sikes
*Assistant Examiner*—Huy Mai
*Attorney, Agent, or Firm*—Robin, Blecker, Daley & Driscoll

[57] ABSTRACT

A hanging arrangement comprises eyeglasses inclusive a bow supporting lenses aside a nose bridge thereof, the bow defining first and second temple supports at first and second ends thereof, and first and second temples joined respectively with the first and second temple supports and a hanger secured with the eyeglasses and hanging the eyeglasses with the first and second temple supports in vertical alignment. The hanger is comprised of a one-piece molded plastic body comprising a display portion having an opening therethrough for receipt of a display rod and a tail depending from the display portion, the tail having first and second successive segments, the first segment having an opening therethrough, the second segment having a reduced thickness portion pierceable by the eyeglass temple to define an opening on assembly of the hanger with the eyeglasses. The hanger defines a further reduced thickness portion adjacent the first segment opening.

28 Claims, 6 Drawing Sheets

EYEGLASSES HANGER HAVING A REDUCED THICKNESS PORTION VERTICALLY ADJACENT THE TAIL SEGMENT OPENING

CROSS-REFERENCE TO RELATED APPLICATION

This application is a continuation-in-part of Application Ser. No. 08/366,254, filed on Dec. 29, 1994.

FIELD OF THE INVENTION

This invention relates generally to article hangers and pertains more particularly to hangers for the hanging of eyeglasses.

BACKGROUND OF THE INVENTION

For reference purposes, applicants define "eyeglasses" as including "lenses", a "bow" for supporting the lenses and having a "nose bridge" centrally thereof, and "temples" which are rotatively supported by the bow and comprise side supports for the eyeglasses passing on each side of the user's head.

U.S. Pat. No. 5,144,345, No. 5,260,726 and No. 4,976,532 relate to the hangers for hanging eyeglasses such that they are horizontal, i.e., as they appear when worn. Plural hangers with eyeglasses are commonly mounted on a cantilever-supported display rod, the hangers having an opening shaped jointly with the rod to impart the horizontal disposition to the eyeglasses.

The manner of hanging of eyeglasses in the referenced patents is seen by applicants to have the disadvantage of the hanger being attached to the nose bridge and preventing the potential purchaser from viewing the eyeglasses, either on the display rod or removed and worn, without also viewing the obtrusion of the hanger.

A primary object of the parent application, above-referenced, was to provide improved hangers for eyeglasses and, more particularly, to provide a hanger for eyeglasses which permits a potential purchaser to fully view the bow of the eyeglasses without also viewing the hanger.

In a first aspect, eyeglasses of the parent application are inclusive of a bow supporting lenses aside a nose bridge thereof, the bow defining first and second temple supports at first and second ends thereof, and first and second temples joined respectively with the first and second temple supports and a hanger secured with the eyeglasses and hanging the eyeglasses with the first and second temple supports in vertical alignment. The combination further includes a hanger support rod, the hanger defining an opening therethrough, the hanger support rod being resident in the hanger opening.

In a second aspect, eyeglasses of the parent application are inclusive of a bow supporting lenses aside a nose bridge thereof, the bow defining first and second temple supports at first and second ends thereof, and first and second temples joined respectively with the first and second temple supports and are combined with a hanger secured with the eyeglasses at the location of joinder of the first temple and the first temple support.

In a first hanger aspect, the parent application provides a hanger comprised of a one-piece molded plastic body comprising a display portion having an opening therethrough for receipt of a display rod and a tail depending from said display portion, the tail having first, second and third successive segments and hinge parts between the first and second segments and between the second and third segments.

In a second hanger aspect, the parent application provides a hanger comprised of a one-piece molded plastic body comprising a display portion having an opening therethrough for receipt of a display rod and a tail depending from the display portion, the tail having first and second successive segments, the first segment having an opening therethrough, the second segment having a reduced thickness portion pierceable to define an opening on assembly of the hanger with an article to be hung thereby.

SUMMARY OF THE INVENTION

The foregoing and other objects and features of the invention will be further evident from the following detailed description of preferred embodiments thereof and from the drawings in which like components are identified by like reference numerals throughout.

DETAILED DESCRIPTION OF PREFERRED EMBODIMENTS AND PRACTICES

Figure 2:
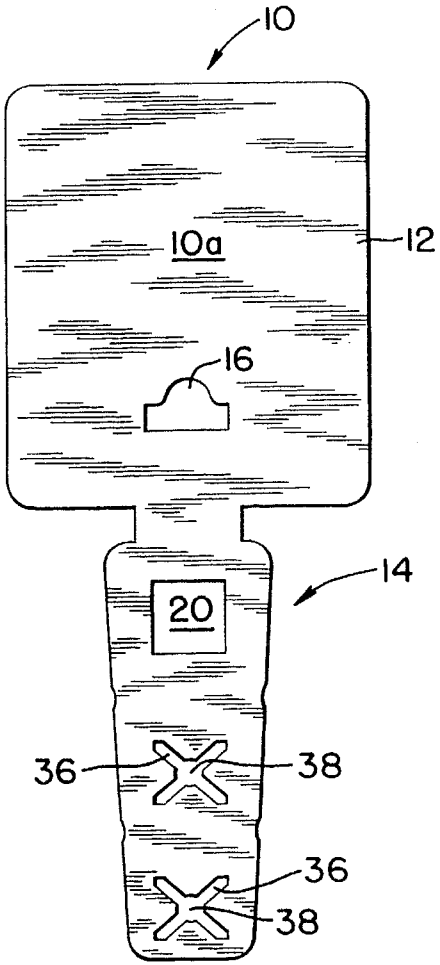
FIG. 2 is a rear elevation of the FIG. 1 hanger.
Figure 1:
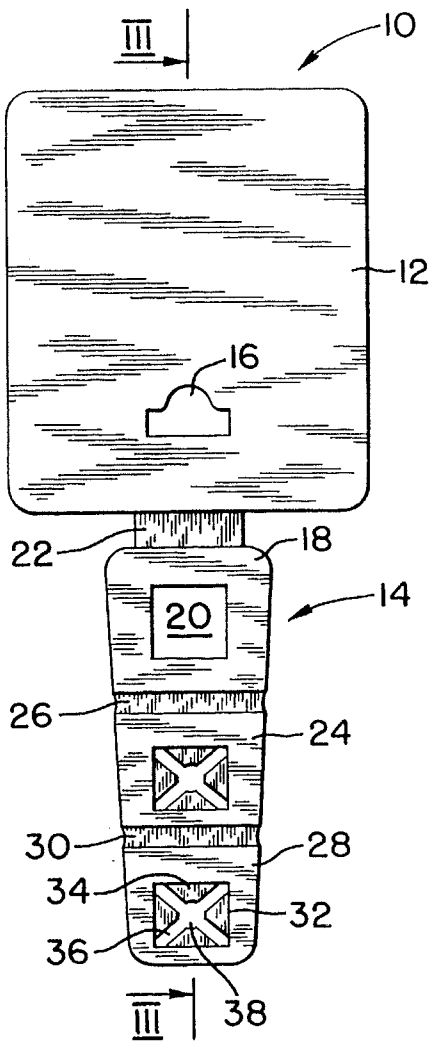
FIG. 1 is a front elevation of a first embodiment of a hanger in accordance with the parent application.
Figure 3:
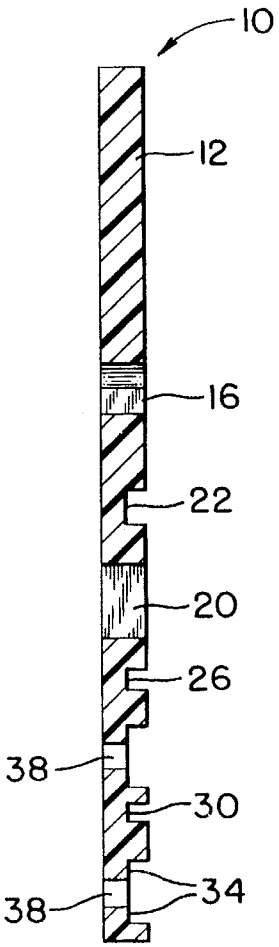
FIG. 3 is a sectional view of the FIG. 1 hanger as would be seen from plane III—III of FIG. 1.

Referring to FIGS. 1–3, hanger 10 is constituted as a one-piece molded plastic body having a display portion 12 and a tail 14. Display portion 12 has and opening 16 adapted for receipt of a display rod.

Tail 14 has a first segment 18 which defines an opening 20 and is pivotally supported by the display portion by a hinge part 22 which, for such purpose, is of a lessened thickness with respect to the display portion.

A second tail segment 24 depends from first tail segment 18 and is pivotally supported by first tail segment 18 by a hinge part 26, which, again for such purpose, is of a lessened thickness with respect to first segment 18.

A third tail segment 28 depends from second tail segment 24 and is pivotally supported by second tail segment 24 by a hinge part 30, which, again for such purpose, is of a lessened thickness with respect to second segment 18.

As is evident from FIG. 2, rear surface 10*a* of hanger 10 is continuous and unapertured, other than for openings 16, extending through display portion 14 and 20 extending through tail first segment 18.

Each of tail segments 24 and 28 is likewise configured to be pierceable by a temple and to then be frictionally associated therewith. To this end, for segment 28, interior portion 32 has four triangularly-shaped areas 34 which are of thickness comparable to the reduced thickness of hinges 22, 26 and 30. Troughs 36 of still further reduced thickness are formed between respective areas 34 to form a cruciform having central circular portion 38.

Figure 4:
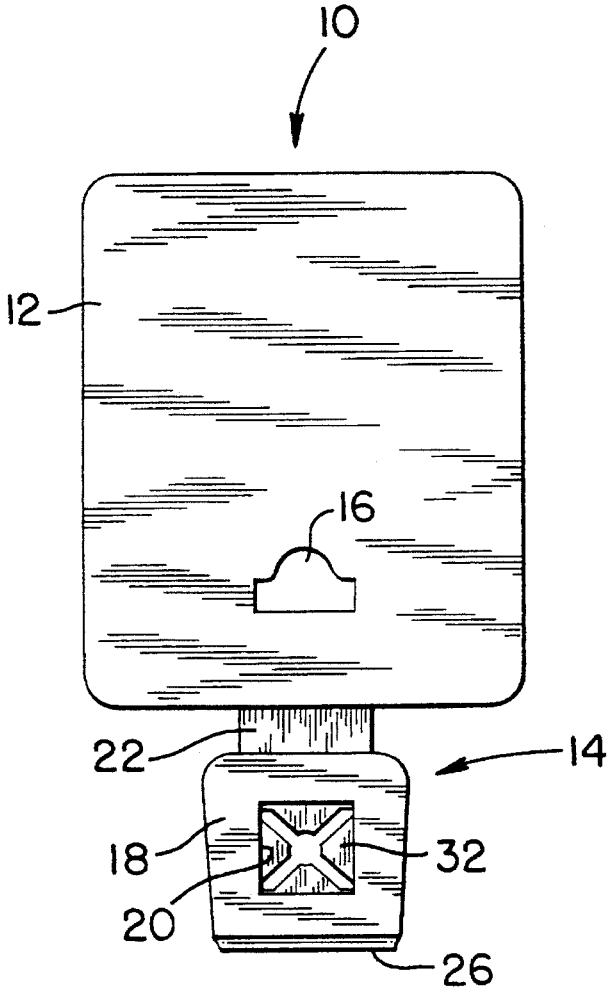
FIG. 4 is a front elevation of the FIG. 1 hanger with its tail folded.
Figure 5:
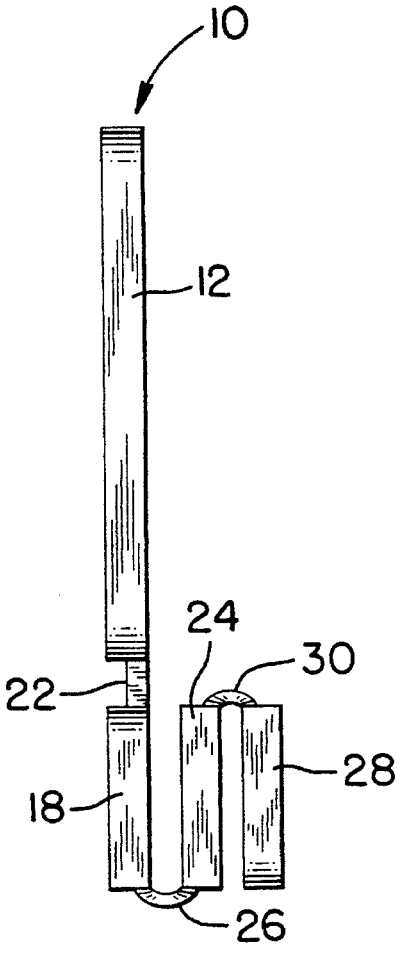
FIG. 5 is a right side elevation of FIG. 4.
Figure 6:
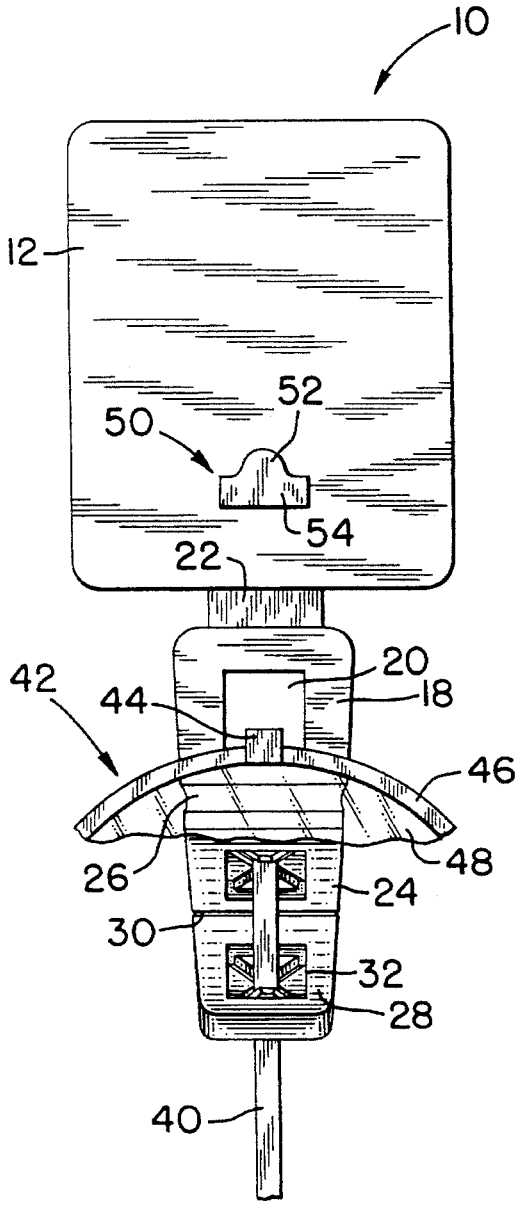
FIG. 6 is a front elevation of the FIG. 1 hanger with eyeglasses hung thereby from a display rod.

In preparing hanger 10 for assembly with a temple, tail 14 is folded as is shown in FIGS. 4 and 5, whereby interior portion 32 of tail segment 24 is in positional registry with opening 20 of tail segment 18. Interior portion 32 of segment 28, not seen in FIG. 4, is in positional registry with opening 20 of tail segment 18 and with interior portion of tail segment 24. Temple 40 (FIG. 6) has its free end forced into opening 20 and piercingly through interior portions 32 of segments 24 and 28 to yield the assembly shown in FIGS. 6 and 7, to which reference is now made.

Figure 7:
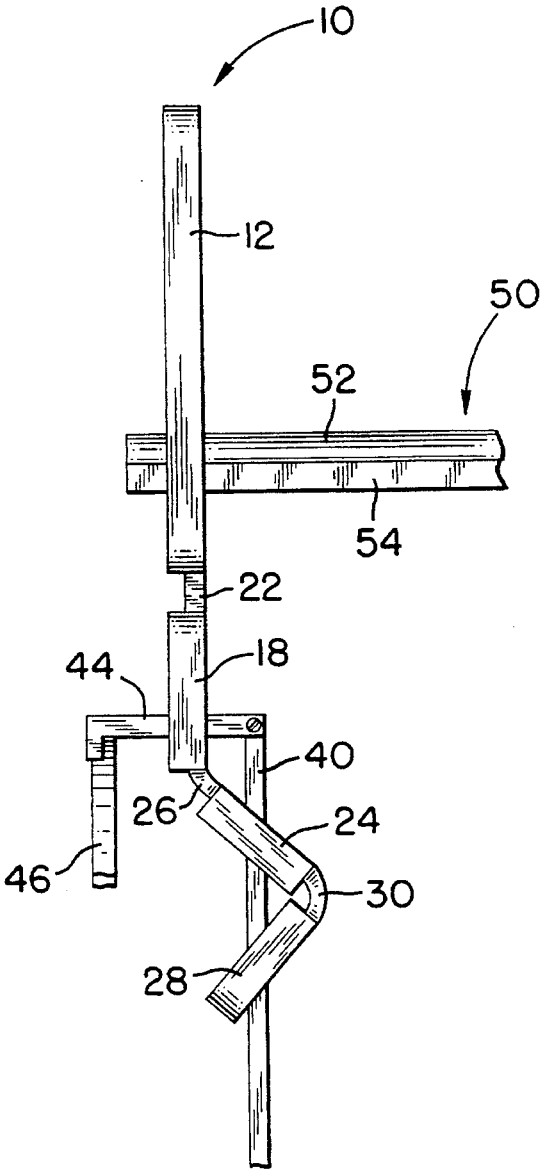
FIG. 7 is a right side elevation of FIG. 6.

Eyeglasses 42 include temple 40, temple support 44, bow 46 and lens 48. Temple support 44 is disposed in opening 20 of tail segment 18. In the hung disposition, temple 40 is pivoted to be at a right angle to temple support 44 and is thus dressed along bow 46, rearwardly thereof. Temple 40 extends through interior portions 32 of tail segments 24 and 28, having pierced the same in assembly, and frictionally engages the same. As is seen in FIG. 7, segments 24 and 28 make substantially forty-five degree angles with respect to temple 40. Support member 50 has upper arcuate part 52 and beam 54, thus configured to receive hanger display portion 12 and to reside in opening 16 thereof.

Figure 8:
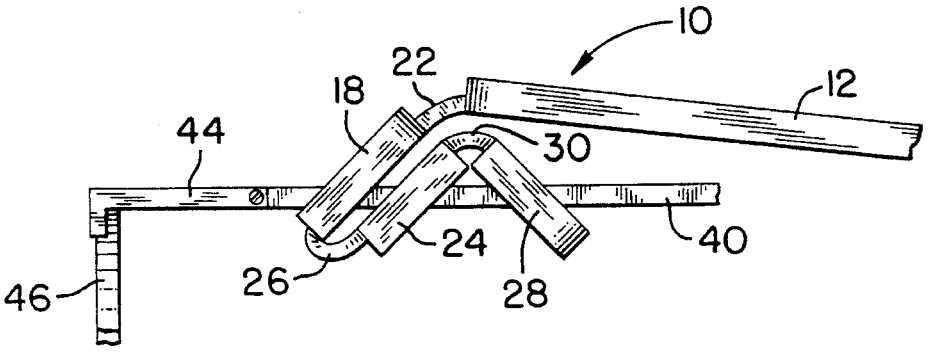
FIG. 8 is a partial side view of the hanger of FIG. 1 in assembly with a temple of the FIG. 6 eyeglasses and disposed such that a user can view the full bow thereof with the hanger still attached.

In FIG. 8, hanger 10 is removed from support member 50, remaining in assembly with temple 40. Display portion 12 is displaced to be dressed along temple 40. As such, tail segment 24 is now in facing relation to segment 28 and hinge 22 permits movement of display portion 12 to be in facing relation to temple 40.

As will be appreciated, the entirety of bow 46, lens 48 and temple support 44 can be seen when the potential purchaser tries on the eyeglasses. Thus, opening 20 is sized, as is tail segment 18, to permit passage therethrough of temple support 44. Further enabling this desirable result is the arrangement of the multiple mutually pivotal tail segments. To return the hanger and eyeglasses to support member 50, one simply retrieves the relation of parts to that shown in FIGS. 6 and 7.

Figure 11:
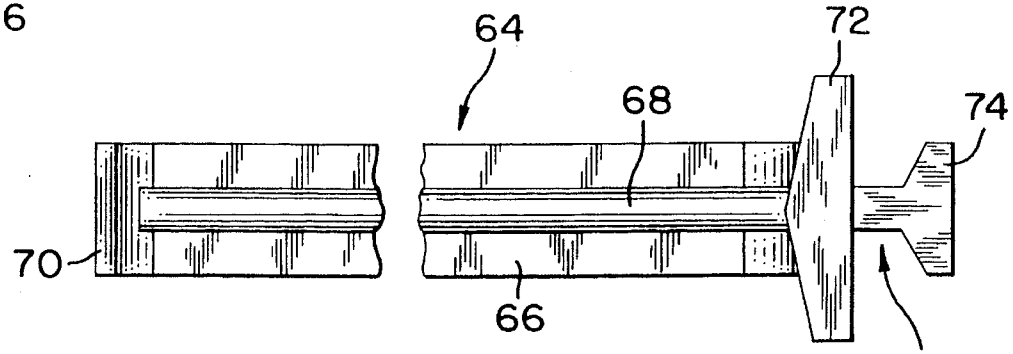
FIG. 11 is a top plan view of FIG. 10.
Figure 10:
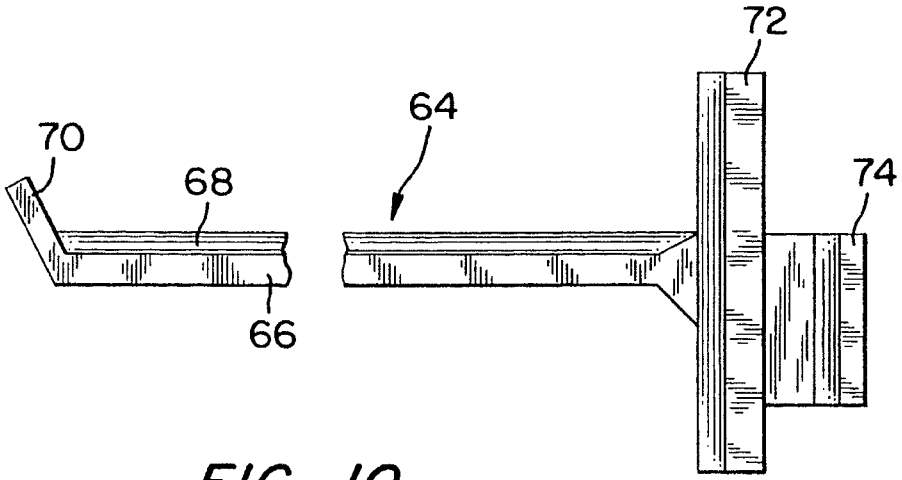
FIG. 10 is side elevation of a display rod for use with the hanger of FIG. 9.
Figure 9:
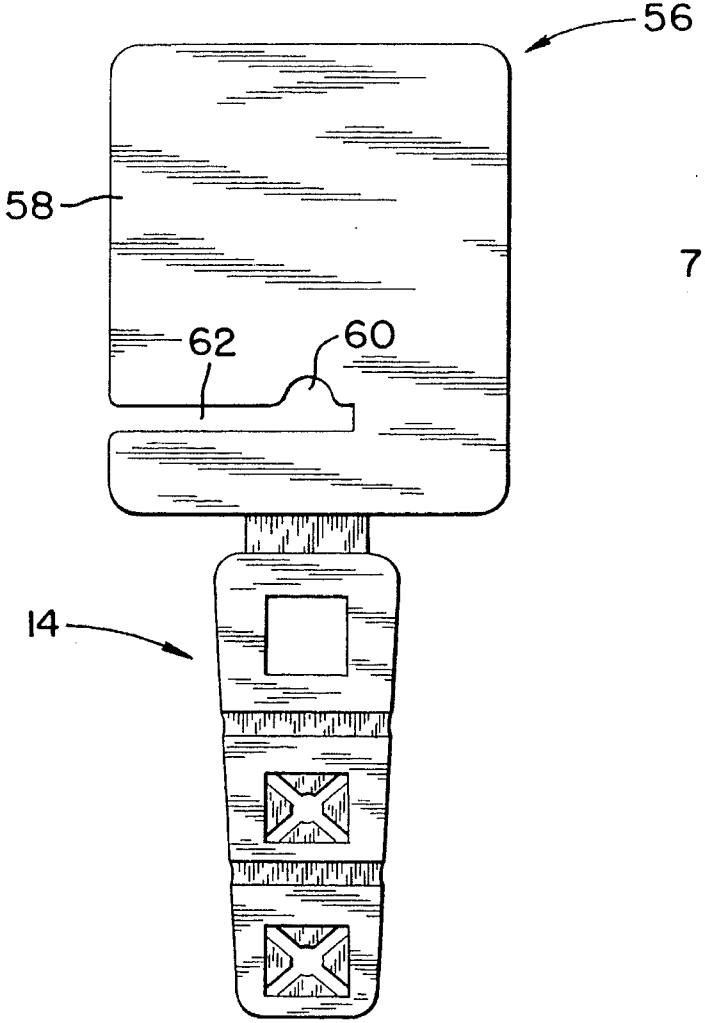
FIG. 9 is a front elevation of a second embodiment of a hanger in accordance with the parent application.

Turning to FIGS. 9–11, hanger 56 includes display portion 58, which has opening 60 therethrough and a channel 62 extending from opening 60 and opening into the left side margin of display portion 58. Hanger 56 is otherwise identically configured with hanger 10, i.e., it has tail 14.

Support member 64 has beam 66 and arcuate upper portion 68 and both thereof are terminated at one end with inclined member 70. The cross-section of beam 66 and arcuate upper portion 68 is complemental to opening 60 of display portion 58. At its other end, support member has structure for hanging the same in cantilever fashion of a known display rack (not shown), i.e., arms 72 and 74 with nest 76 therebetween.

Hanger 56 is applied to support member 64 by aligning a side of beam 66 with channel 62 and deflecting the upper part of display portion 58 sufficiently to permit passage of the beam and arcuate upper portion 68 into opening 60 and then allowing the upper part of display portion to self-biasingly return to the plane of the hanger. Inclined member 70 and arm 72 provide for horizontal retention of hangers with support member 64 in the absence of such removal thereof. As will be appreciated, reversal of these steps will permit return of the hanger to a supported situation.

As noted above, opening 20 is sized, as is tail segment 18, to permit passage therethrough of temple support 44. It is found, however, for large sized temple supports, when a Customer returns the hanger and eyeglasses to the relation of parts to that shown in FIGS. 6 and 7, the hinge of the temple support can become engaged with the part of the hanger immediately upwardly of opening 20 in FIG. 1.

Figure 12:
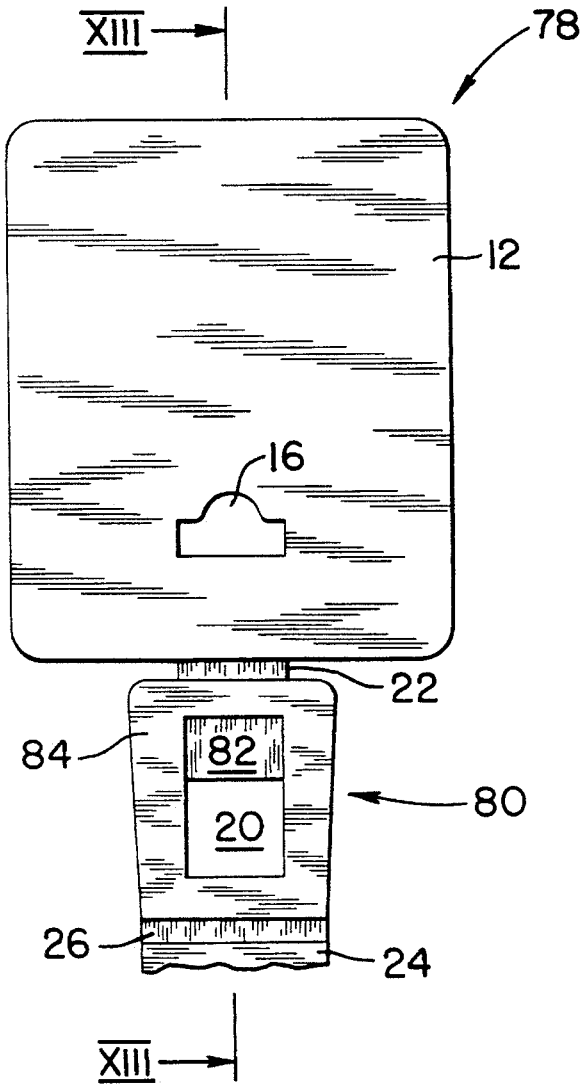
FIG. 12 is partial front elevation of the upper portion of a first hanger in accordance with the present invention.
Figure 13:
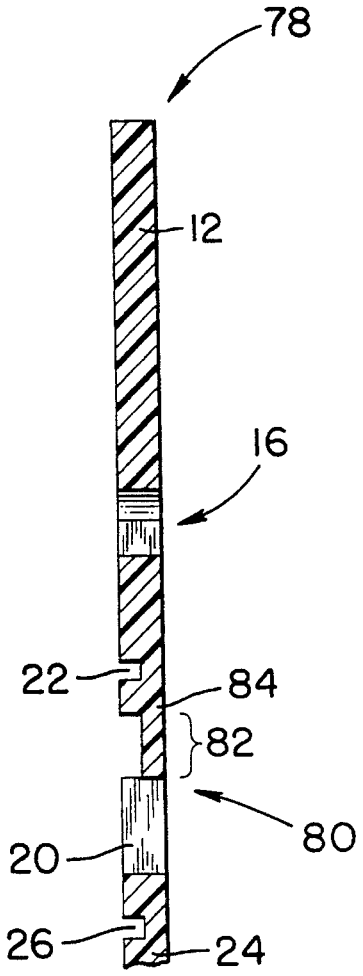
FIG. 13 is a sectional view of the FIG. 12 hanger as would be seen from plane XIII—XIII of FIG. 12.

In addressing this situation, the subject invention provides a first modified hanger 78, the upper portion of which is shown in FIGS. 12 and 13. Hanger 78 is configured with various parts of the FIG. 1 hanger, as indicated by the common reference numerals in FIGS. 1 and 12. Hanger 78 differs however in its tail 80, and particularly by including reduced thickness portion 82 in the first tail segment 84. As is seen in FIG. 13, portion 82 is less than half the thickness of the remainder of first tail segment 84. It is found that hanger 78 substantially reduces entanglement of the hinge of the temple support with the part of the hanger immediately upwardly of the first tail segment opening based on such reduced thickness portion adjacent the opening.

Figure 15:
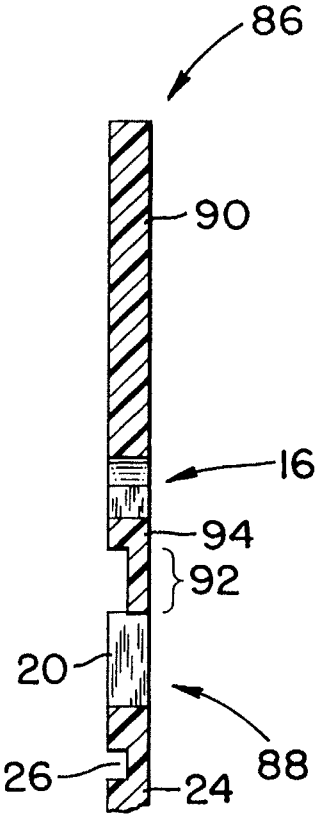
FIG. 15 is a sectional view of the FIG. 14 hanger as would be seen from plane XV—XV of FIG. 14.
Figure 14:
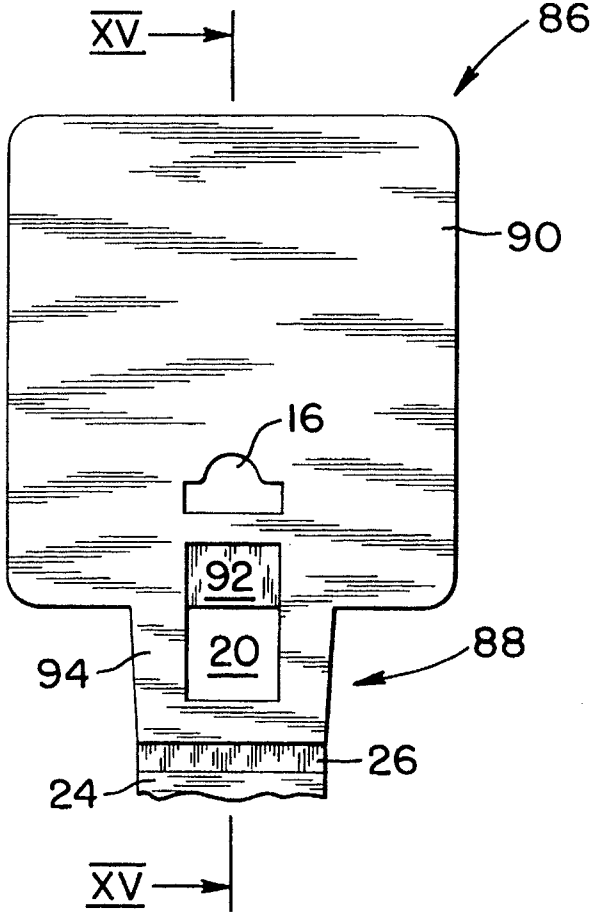
FIG. 14 is partial front elevation of the upper portion of a second hanger in accordance with the present invention.

The subject invention also addresses the matter of increased display density for eyeglasses in defining hanger 86, shown in FIGS. 14 and 15. Hanger 86 is configured with various parts of the FIG. 1 hanger, as indicated by the common reference numerals in FIGS. 1 and 14. Hangers 86 differs however in several respects. Tail portion 88 is configured without a reduced thickness portion corresponding to portion 22 of hanger 10. Further, hanger 86 includes display portion 90 which defines reduced thickness portion 92 adjacent opening 20 of tail first segment 94.

Figure 16:
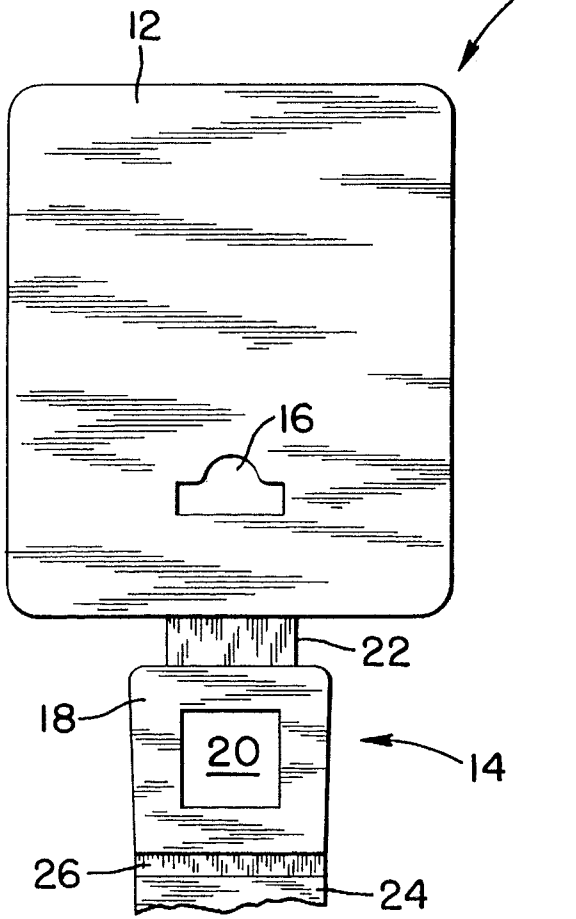
FIG. 16 is a repeat showing of the upper portion of the FIG. 1 hanger.

As is seen by comparing FIGS. 14 and 16, hanger 86, in addition to overcoming the temple hinge and hanger entanglement problem, is of lesser vertical extent than hanger 10, thus affording increased density in eyeglasses display.

Various changes to the particularly disclosed embodiments and methods may evidently be introduced without departing from the invention. Accordingly, it is to be appreciated that the particularly discussed and depicted preferred embodiments and practices of the invention are intended in an illustrative and not in a limiting sense. The true spirit and scope of the invention are set forth in the ensuing claims.

What is claimed is:

1. In combination:

(a) eyeglasses inclusive of a bow supporting lenses aside a nose bridge thereof, the bow defining first and second temple supports at first and second ends thereof, and first and second temples joined respectively with the first and second temple supports; and (b) a hanger secured with the eyeglasses and hanging the eyeglasses with the first and second temple supports in vertical alignment, the hanger comprising a display portion and a tail depending from the display portion, the tail portion having a first segment which defines an opening in which the first temple support is resident, the hanger defining a reduced thickness portion vertically adjacent the opening.

2. The invention claimed in claim 1, wherein the hanger reduced thickness portion is situated in the display portion.

3. The invention claimed in claim 1, wherein the hanger reduced thickness portion is situated in the tail portion.

4. The invention claimed in claim 1, further including a hanger support rod, the hanger defining an aperture therethrough, the hanger support rod being resident in the hanger aperture.

5. The invention claimed in claim 1, wherein the tail portion first segment is pivotally supported by the display portion.

6. The invention claimed in claim 5, wherein the tail portion has a second segment having an opening therethrough, the first temple being resident in the tail portion second segment opening.

7. The invention claimed in claim 6, wherein the tail portion second segment is pivotally supported by the tail portion first segment.

8. The invention claimed in claim 7, wherein the tail portion has a third segment having an opening therethrough, the first temple being resident in the tail portion third segment opening.

9. The invention claimed in claim 8, wherein the tail portion third segment is pivotally supported by the tail portion second segment.

10. The invention claimed in claim 1, wherein the tail portion retentively engages the first temple at plural spaced locations thereon.

11. A hanger comprised of a one-piece molded plastic body comprising a display portion having an aperture therethrough for receipt of a display rod and a tail portion depending from the display portion, the tail portion having a first segment which defines an opening therethrough, the hanger defining a reduced thickness portion vertically adjacent the opening.

12. The hanger claimed in claim 11, wherein the hanger reduced thickness portion is situated in the display portion.

13. The hanger claimed in claim 11, wherein the hanger reduced thickness portion is situated in the tail portion.

14. The hanger claimed in claim 11, wherein the tail portion first segment is pivotally supported by the display portion.

15. The hanger claimed in claim 14, wherein the tail portion has a second segment having an opening therethrough.

16. The hanger claimed in claim 15, wherein the tail portion second segment is pivotally supported by the tail portion first segment.

17. The hanger claimed in claim 16, wherein the tail portion has a third segment having an opening therethrough.

18. The hanger claimed in claim 17, wherein the tail portion third segment is pivotally supported by the tail portion second segment.

19. The hanger claimed in claim 18, wherein the hanger includes a further hinge part between the display portion and the tail.

20. A hanger comprised of a one-piece molded plastic body comprising a display portion having an opening therethrough for receipt of a display rod and a tail depending from the display portion, the tail having first and second successive segments, the first segment having an opening therethrough, the second segment having a reduced thickness portion pierceable to define an opening on assembly of the hanger with an article to be hung thereby, the hanger defining a further reduced thickness portion vertically adjacent the first segment opening.

21. The hanger claimed in claim 20, wherein the hanger reduced thickness portion is situated in the display portion.

22. The hanger claimed in claim 21, wherein the hanger reduced thickness portion is situated in the tail portion.

23. The hanger claimed in claim 20, wherein the tail portion first segment is pivotally supported by the display portion.

24. The hanger claimed in claim 23, wherein the tail portion has a second segment having an opening therethrough.

25. The hanger claimed in claim 24, wherein the tail portion second segment is pivotally supported by the tail portion first segment.

26. The hanger claimed in claim 25, wherein the tail portion has a third segment having an opening therethrough.

27. The hanger claimed in claim 26, wherein the tail portion third segment is pivotally supported by the tail portion second segment.

28. The hanger claimed in claim 27, wherein the hanger includes a further hinge part between the display portion and the tail.

* * * * *